United States Patent [19]

Matthews

[11] 4,188,899

[45] Feb. 19, 1980

[54] SEWING MACHINES AND METHOD FOR JOINING PIECES OF FABRIC

[75] Inventor: Dennis Matthews, Sutton-in-Ashfield, England

[73] Assignee: Mathbirk Limited, Sutton-in-Ashfield, England

[21] Appl. No.: 905,195

[22] Filed: May 12, 1978

[30] Foreign Application Priority Data

May 14, 1977 [GB] United Kingdom ..... 20387/77

[51] Int. Cl.[2] ..... D05B 1/00; D05B 97/00

[52] U.S. Cl. ..... 112/262.1; 112/25

[58] Field of Search ..... 112/25, 27, 262

[56] References Cited

U.S. PATENT DOCUMENTS

| | | | |
|---|---|---|---|
| 3,023,720 | 3/1962 | Underwood et al. | 112/25 |
| 3,083,655 | 4/1963 | Beck et al. | 112/27 |
| 3,153,393 | 10/1964 | DeSpain | 112/25 |
| 3,316,866 | 5/1967 | Shelton | 112/25 |
| 3,425,370 | 2/1969 | Starnes | 112/25 |
| 3,479,976 | 11/1969 | Flach et al. | 112/25 |
| 3,490,396 | 1/1970 | Conti | 112/25 |
| 3,499,403 | 3/1970 | Flaque | 112/25 |
| 3,505,964 | 4/1970 | Flaque | 112/25 |

*Primary Examiner*—Ronald Feldbaum

*Attorney, Agent, or Firm*—Frailey & Ratner

[57] ABSTRACT

A sewing machine having a rotatable inner disc, on which is supported a needle and a thread guide for rotation with the disc, and a rotatable outer ring mounting a plurality of radially extending points on which fabrics to be joined together are impaled. The inner disc and outer ring are generally co-planar, and are rotatable, both in unison and relative to each other, about a common axis. The disc and ring are rotatable together manually to a selected work location, at which exposed points are presented to an operator for impalement of fabrics to be joined together. The exposed points remain stationary at such location during fabric impalement. While the outer ring is stationary for impalement of fresh fabric pieces, the inner disc, supporting the needle and thread guide, rotates relative to the ring of points, whereby fabrics previously impaled on the points are sewn together. The arrangement permits the operator to impale fresh fabrics on stationary points at the work location while the machine sews together pieces of fabric previously impaled. The improved machine is particularly useful in joining together fabrics of relatively short length, such as the sewing together of the openings of half hose, following removal from the knitting machine.

11 Claims, 3 Drawing Figures

SEWING MACHINES AND METHOD FOR JOINING PIECES OF FABRIC

This invention is for improvements in or relating to sewing (linking, oversewing and seaming) machines. Machines of a general kind to which the present invention relates are described more particularly in the specifications of British Letters Patent No. 1016531/2/3.

Such machines are used for the joining together of pieces of fabric by the running on of the fabric onto radial extending points, and then operating on the fabric while on the points by a needle with a thread to form a chain stitch. One or more needles may be provided to form either a single thread chain stitch or multiple thread chain stitches.

In the joining together of fabrics to form cardigan sleeves, sweaters and such like, the length of run on may occupy anything upto half or more than half of the circumference of the radial extending points. However, with the joining together of socks (half hose) only a few inches of fabric are involved and the running on of this fabric onto the points is a more time consuming operation, than when running on long lengths of fabric particularly if the points are not presented in a uniform manner to the operator. One desirable feature therefore for the joining of parts of a sock is that the points should always be presented in exactly the same place so that an operator may pick up the parts of the sock to be joined and impale them straight onto the points, and if the machine could then be so moved that further exposed points could be presented to the operator while the previously run on fabric is operated on by the needle, an increase in efficiency of the joining of parts of the sock using a sewing or linking machine would be obtained.

Accordingly, it is part of the present invention to provide a sewing machine of the kind hereinbefore referred to, having radial extending points, a needle for sewing together fabric impaled onto said radial extending points by a single chain stitch in which relative rotation between the needle and the points is such that while fabric impaled on the points is being sewn the points themselves do not rotate about a central axis.

According to the present invention, it is the needle and the motor driving the needle, and the associated drive mechanism from the motor to said needle and thread guide, that is rotated about a vertical axis relative to stationary points. The points are only rotated when, after an operater has impaled fabric thereon, the operator then manually rotates the points from the position in front of her and in so doing sets the machine going by moving a micro-switch away from a given stop and the machine is then started to operate onto the fabric impaled on said points. While this is happening the points remain stationary so that an operator may then impale further fabric onto the stationary points.

Figure 1:
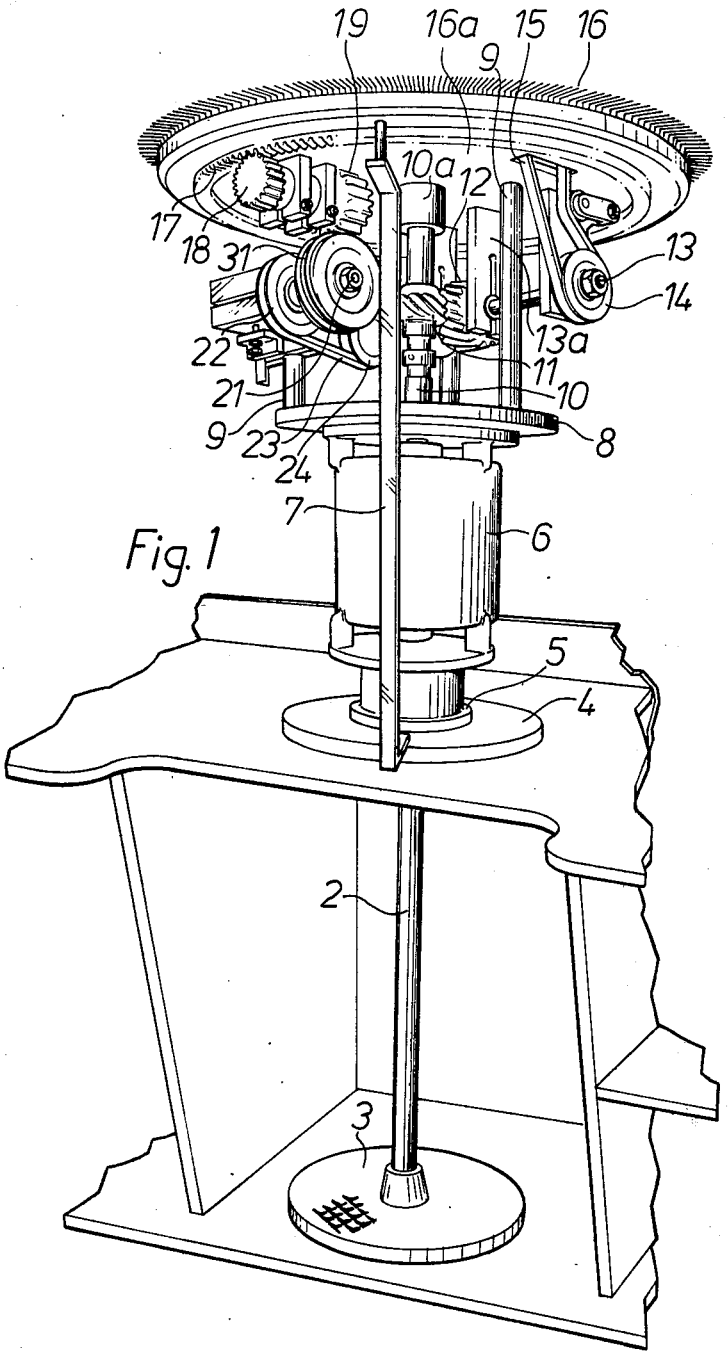
Figure 2:
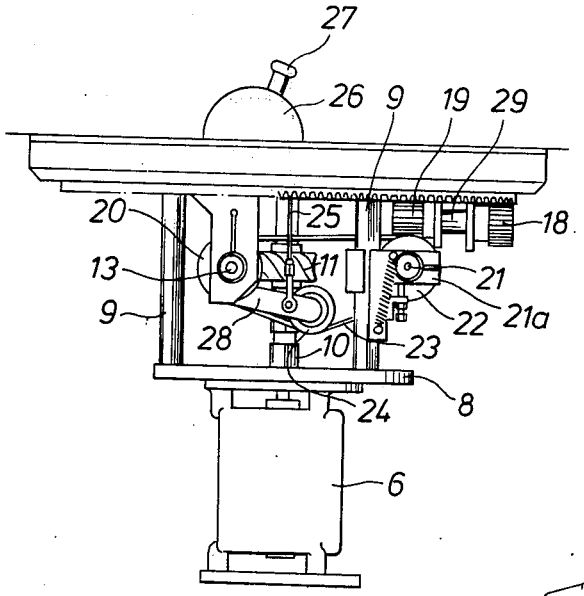
Figure 3:
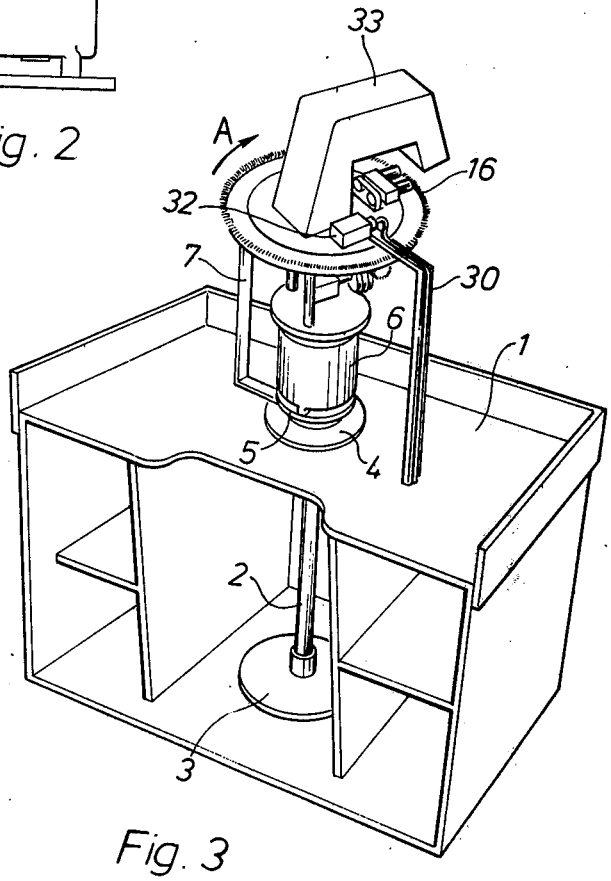

In order that the present invention may be more readily understood reference is now made to the drawings accompanying the Provisional Specification in which:

FIG. 1 is a perspective view of a sewing machine according to the present invention, FIG. 2 is a side view showing in greater detail the mechanism of the present invention, and FIG. 3 is a top perspective view.

In the figures a motor 6 is mounted for rotation on bearings 5 relative to a rotatable disc 4 itself rotatable relative to a surface of a table 1. Beneath the table 1 is a rod 2 connected to a foot engaging disc 3 so that by rotating the disc 3 by foot the disc 4 is also rotated. Above the motor 6 is carried a plate 8 from which three pillars 9 upstand to support the assembly, including the radial extending points dial 16 and the inner disc 16A. The inner disc 16A and dial 16 are rotatable in unison about a common axis. Additionally, the disc is rotatable relative to dial 16 when the dial is stationary. A central drive shaft 10 connected to the electric motor 6 extends upwardly to connect to a hub 10A secured beneath the disc 16A. The shaft 10 carries a helical gear 11 which is in driving engagement with a helical gear 12 mounted on a shaft 13 supported in brackets 13A from beneath the disc 16A. The shaft 13 carries a pulley 20 which has a belt 23 running around it to enable the pulley 20 to drive a pulley 22 mounted for rotation on an axle 21 supported in brackets 21A from the pillars 9. An idler pulley 24 is also driven by the belt 23. The idler pulley 24 is mounted on a pivoted arm 28 which arm is connected by a link 25 to a lever 27 secured in a quadrant 26. By movement of the lever 27 relative to the quadrant 26, the link 25 may be raised and lowered vertically (FIG. 2) and in so doing the length of the belt 23 which is the effective driving engagement between the pulley 20 and the pulley 22 may be varied. The pulley 20 is of an infinitely variable diameter pulley, in the sense that one half of the pulley is spring loaded relative to the other half and both halves have a surface which together defined a 'V' so that the diameter may be varied according to the length of the belt 23 which is in driving engagement. By this means, an infinitely variable drive ratio between shaft 13 and shaft 21 is obtained.

Also mounted on shaft 21 is a worm 31 which is in driving engagement with a pinion 19 mounted on a shaft 29. Mounted on the free end of shaft 29 is a pinion 18 which drives the radial extending disc 16A via a circular gear 17. Also carried on shaft 13 is a pulley 14 which is in a driving engagement by a belt 15 with the needle and thread guide which forms part of the sewing machine according to known techniques. An arm 7 secured to the disc 4 is in fixed engagement with the radial extending dial 16, so that rotation of disc 4 causes rotation of dial 16 in unison therewith. As seen in FIG. 3 a pillar 30 upstands from the table 1, and carries at its free end a micro-switch 32. A stop (not shown) is secured to a cover 33 housing the mechanism for operating the needle according to known techniques for sewing machines of the kind to which the present invention relates. The stop is arranged to contact the actuating mechanism of the micro-switch 32.

In use an operator will impale fabric onto the base points of the radial extending points dial 16 and will then rotate manually either by hand or by engaging the foot engaging disc 3 the assembly in the direction of the arrow A, (FIG. 3). In so doing the radial extending points ring 16 together with the disc 16A will be rotated in unison in clock-wise direction (as viewed from above) and presented to the operator will be some points which do not have fabric thereon. In manually rotating the assembly in the direction of arrow A, the micro-switch 32 will be disengaged from the stop and the motor 6 started. On starting the motor 6 the drive shaft 10 is operated, and from the drive shaft 10 the needle within the housing 33 together with the thread guide is actuated to commence forming a chain stitch according to known manner, and at the same time the pinion 18 drives the ring gear 17 to rotate the assembly of motor 6 and the disc 16A and all the components mounted thereon, in an anti-clockwise direction relative to the now stationary points dial 16 until such time as the micro-switch 32 again makes contact with the stop and at which point the motor is switched off and no further sewing or linking takes place.

Thus it will be appreciated that in use an operator is able confidently to be feeding fabric to be linked or sewn onto stationary points while at the same time fabric which has previously been impaled onto said points, is being sewn by the mechanism housed within the rotating casing 33. The disc 16A and dial 16 are rotatable together manually to a selected location at which exposed points are presented to the operator for impalement of fabrics to be joined together. The exposed points remain stationary at such location during fabric impalement. While the dial 16 is stationary for impalement of fresh fabric pieces, the inner disc 16A, supporting the needle and thread guide, is rotated by motor 6 relative to the dial 16, whereby the fabrics previously impaled on the points are sewn together.

The present invention also includes brush (not shown) adjacent to the needle which forms the single chain stitch. Normally after stitching fabric such as a sock the surplus material above the stitch is cut off so as to reduce the height of the join of the fabric. However small pieces of thread may remain locked in the fabric. In order to clean the stitch the present invention provides for two counter rotating brushes to brush the stitch after the removal of the surplus fabric. These two brushes may be driven from either shaft 13 or shaft 21 by any convenient means (not shown). The brushes will be a disc with bristles impaled in the periphery thereof.

It is thought that the present invention is particulary suitable for the linking or sewing and joining together of the ridge across socks which are being formed on a half hose machine rendering the apparatus especially suitable for the linking of half hose in which short lengths of fabric only are to be impaled onto the points. It is claimed by arranging for the linking needle and thread guide to be rotated relative to stationary points as opposed to the more conventional arrangement in which the linking needle remains stationary and the points are rotated to take the fabric past the needle, a higher rate of production can be obtained from an operator whose function it is to impale the fabric to be linked on to said points.

What I claim is:

1. A sewing machine of the kind hereinbefore referred to having a dial provided with a plurality of radially extending points, a needle for sewing together fabric impaled on to said radially extending points by a single chain stitch, said dial and said needle being rotatable about a common axis, means for advancing the dial rotatably to a selected position after fabric has been impaled on some of the points to present bare points to a machine operator for impalement of new fabric while the dial is stationary, drive means for rotating the needle relative to the dial, whereby the first fabric impaled on the points is being sewn by the needle while the points are stationary for impalement of the said new fabric

2. A sewing machine according to claim 1 having more than one needle for sewing together fabric impaled on to the points.

3. A sewing machine according to claim 1 in which the radially extending points are adapted to rotate about a central axis of the machine such that an operator is able to impale fabric onto the points substantially at the same position each time.

4. A sewing machine according to claim 1 further including a drive mechanism for said needle, said drive mechanism and needle being rotatable together about a substantially vertical axis relative to the stationary points during the sewing operation.

5. A sewing machine according to claim 4 further including a micro-switch automatically operative, when the dial is advanced to the selected position, to actuate the needle drive mechanism and the drive means to set in motion the sewing operation.

6. A sewing machine according to claim 1 further including a substantially horizontal work bench having a foot engaging portion located beneath said work bench for advancing the dial to the selected position.

7. A sewing machine according to claim 1 in which the dial is advanced by the operator in a clockwise direction, and in which the needle, when sewing the fabric impaled on to the said points, moves in an anti-clockwise direction relative to said dial.

8. A sewing machine according to claim 1 wherein the dial is annular, and further including a rotatable disc disposed internally of the annular dial, said dial and said disc being rotatable about a common axis, said disc supporting the needle proximate the points on the dial and being selectively rotatable with or relative to the dial.

9. A sewing machine according to claim 8 further including (a) means for advancing the dial and the needle-supporting disc rotatably in unison when the dial is advanced to the selected position, (b) drive means for retracting the disc rotatably relative to the dial while the dial is stationary in the selected position and (c) needle drive mechanism operative to actuate the needle to sew the fabric impaled on the points as the disc is retracted relative to the dial.

10. A method for joining together pieces of fabric by a sewing machine having a rotatable circle of radially extending points and at least one needle for forming a thread into a chain stitch, comprising the steps of impaling fabric on a first plurality of points at a first position while the points are stationary, rotating the points to advance the impaled fabric to a second position and to present a second plurality of points at the first position, after advancing the impaled fabric to the second position, maintaining the points stationary for a selected time interval and, during said time interval, actuating the needle and rotating the needle relative to the points to sew the impaled fabric together while impaling new fabric on the second plurality of needles.

11. A method according to claim 10 wherein the circle of points and the needle are rotatable about a common axis, further including the steps of advancing the points and the needle rotatably in unison to locate the impaled fabric in the second position and, while the impaled fabric is located in the second position, retracting the needle rotatably relative to the points to sew the impaled fabric together.

* * * * *